US008529425B2

(12) United States Patent
Onodera et al.

(10) Patent No.: US 8,529,425 B2
(45) Date of Patent: Sep. 10, 2013

(54) HORIZONTAL CENTRIFUGAL SEPARATOR IN WHICH THE HERMETICITY OF A CASING IS IMPROVED BY USING A SEALING ELEMENT HAVING A SIMPLE STRUCTURE

(75) Inventors: Atsushi Onodera, Tokyo (JP); Keishiro Yamazaki, Tokyo (JP)

(73) Assignee: Tomoe Engineering Co., Ltd., Tokyo (JP)

( * ) Notice: Subject to any disclaimer, the term of this patent is extended or adjusted under 35 U.S.C. 154(b) by 615 days.

(21) Appl. No.: 12/746,353

(22) PCT Filed: Dec. 7, 2007

(86) PCT No.: PCT/JP2007/073664

§ 371 (c)(1), (2), (4) Date: Jun. 29, 2010

(87) PCT Pub. No.: WO2009/072209

PCT Pub. Date: Jun. 11, 2009

(65) Prior Publication Data

US 2010/0273628 A1 Oct. 28, 2010

(51) Int. Cl.
*B04B 1/20* (2006.01)
*B04B 7/02* (2006.01)

(52) U.S. Cl.
USPC ..... 494/38; 494/53; 494/60; 277/641

(58) Field of Classification Search
USPC ..... 494/38–41, 53–54, 56, 60–61; 277/641–642; 210/380.1, 380.3
See application file for complete search history.

(56) References Cited

U.S. PATENT DOCUMENTS 3,802,621 A * 4/1974 Merzenich ..... 494/29
3,837,567 A * 9/1974 Nilson et al. ..... 494/7
4,120,447 A * 10/1978 Jager ..... 494/14
4,654,023 A 3/1987 Földhazy
5,292,137 A 3/1994 Simmons et al.

(Continued)

FOREIGN PATENT DOCUMENTS

BR PI 9106184 A 4/1992
CA 2071221 4/1992

(Continued)

OTHER PUBLICATIONS

International Search Report issued Mar. 11, 2008 in corresponding International Application No. PCT/JP2007/073664.

(Continued)

*Primary Examiner* — Charles E Cooley
(74) *Attorney, Agent, or Firm* — Wenderoth, Lind & Ponack, L.L.P.

(57) ABSTRACT

A horizontal centrifugal separator is configured such that a groove formed along a joint surface between an upper casing and a lower casing constituting the casing is outwardly bent near an opening of the casing, and that an elastic sealing member is disposed in the groove and an end portion thereof abuts against a sealing surface provided on a ring member which is provided so as to surround the outer circumference of the opening of the casing and is pressed against the casing. In this case, surface sealing is constituted by the end portion of the elastic sealing member and the sealing surface of the ring member. In this manner, the hermeticity can be improved without using a sealing member having a complicated structure.

4 Claims, 4 Drawing Sheets

(56) References Cited

U.S. PATENT DOCUMENTS

| | | | | |
|---|---|---|---|---|
| 5,494,579 | A | 2/1996 | Robatel et al. | |
| 6,248,055 | B1 * | 6/2001 | Ostkamp | 494/60 |
| 6,986,733 | B2 * | 1/2006 | Beyer et al. | 494/41 |
| 2010/0273628 | A1 * | 10/2010 | Onodera et al. | 494/39 |

FOREIGN PATENT DOCUMENTS

| | | | |
|---|---|---|---|
| DE | 694 05 051 | T2 | 1/1998 |
| EP | 0 628 970 | A1 | 12/1994 |
| EP | 2228135 | A1 * | 9/2010 |
| FR | 2 706 216 | | 12/1994 |
| JP | 61-136456 | | 6/1986 |
| JP | 5-503142 | | 5/1993 |
| JP | 7-12994 | | 1/1995 |
| JP | 2002-273268 | | 9/2002 |
| JP | 2007-44671 | | 2/2007 |
| JP | 2007044671 | A * | 2/2007 |
| JP | 2007-289824 | | 11/2007 |
| SE | 8405997-1 | | 5/1986 |
| WO | 92/07207 | | 4/1992 |

OTHER PUBLICATIONS

International Preliminary Report on Patentability issued Aug. 19, 2010 in corresponding International Application No. PCT/JP2007/073664.

* cited by examiner (a)

(b)

(a)

(b)

HORIZONTAL CENTRIFUGAL SEPARATOR IN WHICH THE HERMETICITY OF A CASING IS IMPROVED BY USING A SEALING ELEMENT HAVING A SIMPLE STRUCTURE

BACKGROUND OF THE INVENTION

I. Technical Field

The present invention relates to a horizontal centrifugal separator including a rotary bowl and a screw conveyor inserted into the rotary bowl. In particular, the invention relates to a horizontal centrifugal separator including sealing means that, while having a simple structure, can improve the hermeticity of a casing containing the rotary bowl and the screw conveyor.

II. Description of the Related Art

A horizontal centrifugal separator referred to as a decanter is one type of known solid-liquid separator that uses centrifugal force. For example, as shown in FIG. 1, a decanter 1 has a basic structure in which a rotary bowl 11 rotatable about its horizontal axis and a screw conveyor 12 inserted into the rotary bowl 11 are contained in a casing 2 serving as an exterior casing. The casing 2 is separated into a lower casing 21 having a solids outlet 21*a* and a separated-liquids outlet 21*b* formed in the lower part thereof and an upper casing 22 detachable from the lower casing 21. The lower casing 21 and the upper casing 22 have flanges 23 formed along the respective opening edges thereof. The casing 2 having a substantially cylindrical shape is formed by securing the flanges 23 to each other with securing means 24 such as bolts.

Openings 25 having, for example, a circular shape are formed in the opposite end faces of the casing 2, and the rotary shafts of the rotary bowl 11 and the screw conveyor 12 extend through the openings 25 and are rotatably supported by bearing means 13. Mechanical seal housings 14 for sealing the rotary shafts are disposed in the openings 25, and O-rings 15 provided on the outer circumferences of the mechanical seal housings 14 hermetically seal the gaps between the mechanical seal housings 14 and the openings 25.

The barrel portion of the rotary bowl 11 is composed of three portions, i.e., a cylindrical portion on a first end side thereof, an intermediate conical portion, and a circular portion on a second end side. The portion formed into a conical shape forms a beach portion in which solids conveyed by the screw conveyor 12 are separated from liquids and are thereby dewatered. The cylindrical portion on the first end side forms a screen portion for washing the dewatered solids with washing water, and the washed solids are discharged through solids outlets 16. The cylindrical portion on the second end side forms a pool (fluid pool) portion for reserving a feed fluid supplied to the inside of the rotary bowl 11 and has separated-liquids outlets 17 formed in the end face thereof. A screw vane 18 and feed fluid supply ports 19 are formed in the barrel portion of the screw conveyor 12 inserted into the rotary bowl 11, the feed fluid supply port 19 being provided for supplying the feed fluid fed from a feed fluid supply nozzle 3 to the rotary bowl 11 through the action of centrifugal force.

In the structure described above, by transmitting the power of a motor 32 serving as a driving mechanism to a pulley 33 through a rotary belt 31, the rotary bowl 11 is rotated at a predetermined rotation speed. When the feed fluid is supplied to the pool portion while the rotary bowl 11 is rotated, the solids are settled out through the action of the centrifugal force. The solids are conveyed to the beach portion by the screw conveyor 12 rotated through a gearbox 34 used as a differential speed generating mechanism and are then dewatered. The dewatered solids are then washed with washing water from washing water injection ports 35 when they pass through the screen portion. The washing drainage used for washing the solids is discharged through discharge holes 36 formed in the screen portion. The solids having been washed in the screen portion are discharged from the solids outlets 16 and are then discharged to the outside of the separator through the solids outlet 21*a*. The liquids separated from the solids (separated liquids) are discharged from the separated-liquids discharge outlets 17 and are then discharged to the outside of the separator through the separated liquids outlet 21*b*. FIG. 1 shows the decanter of the screen bowl type. However, decanters of the solid bowl type that do not have the screen portion are also widely known.

As described in, for example, patent documents such as Japanese Patent Application Laid-Open No. 2007-44671, a number of studies have previously been conducted to improve the sealing properties of mechanical seals. However, only a few studies have been made to ensure the hermeticity between the mechanical seal housing 14 and the casing 2, which are non-rotating mechanisms. If the set pressure is increased, leakage can occur between the mechanical seal housing 14 and the casing 2. Therefore, in horizontal decanters having a casing structure composed of two separated (upper and lower) casings, the internal pressure thereof during use is limited to several tens kPa or less. At present, when the internal pressure reaches a higher level, the treatment is performed using decanters having an integral cylindrical structure or vertical decanters. However, in decanters having an integral cylindrical structure, the rotary members must be pulled out in the axial direction thereof when disassembled. Therefore, such decanters have drawbacks in that the assembling-disassembling process is complicated and that a sufficiently large space must be provided for maintenance. In particular, decanters of the screen bowl type in which the ratio between the diameter and length of the bowl is large have an influence on the size of buildings. Accordingly, the integral cylindrical structure has not practically been used in such decanters.

SUMMARY OF THE INVENTION

With reference to FIG. 2, the structure of the portion from which leakage occurs is described, in order to elucidate the cause of the leakage. Specifically, as shown in FIG. 2, a groove 27 is formed in an end surface 26 of the lower casing 21, and an O-ring 28 used as a sealing member is disposed in the groove 27, whereby the joint surface between the lower casing 21 and the upper casing 22 is sealed. However, since the opening 25 for allowing the rotary shafts to pass therethrough is formed in the lower casing 21, the O-ring 28 cannot be provided over the entire circumference of the lower casing 21, and the O-ring 28 is discontinuous at the opening 25. In this sealing structure, the end of the O-ring 28 is in point contact with the O-ring 15 of the mechanical seal housing 14, and therefore the hermeticity is low. Moreover, the O-ring 28 is contracted when the separator is operated under, for example, a reduced pressure condition. In such a case, a gap is formed between the O-ring 28 and the O-ring 15, and this results in a further increase in the amount of leakage.

Moreover, in the structure shown in FIG. 2, the O-ring 15 of the mechanical seal housing 14 can be caught between the upper casing 22 and the lower casing 21 when the upper casing 22 is placed on the lower casing 21, for example, at the time of assembly of the separator or after the maintenance. In such a case, the O-ring 15 is deformed, and this causes a problem in that the hermeticity is reduced. In addition, in this structure, the assembling and maintenance operations are "blind" operations in which whether or not the O-ring 15 is caught cannot be visually determined. Therefore, disadvantageously, the point of leakage is not easily determined, and the workability is low.

As described above, the horizontal decanter 1 has a drawback in that the hermeticity is low but has advantages in that its structure is simpler and the cost is lower than those of vertical decanters. Therefore, there is a demand for a horizontal decanter to overcome the problem of hermeticity. However, as the sealing structure becomes complicated, the above advantages of the horizontal decanter 1 are reduced. Therefore, the sealing structure must be as simple as possible. The advantages of the structure of the inventive decanter against the integral cylindrical structure will be described later.

The present invention has been made in view of the above circumstances, and it is an object of the invention to provide a horizontal centrifugal separator in which the hermeticity of a casing is improved by using sealing means having a simple structure.

It is another object of the invention to provide a horizontal centrifugal separator including sealing means configured such that an O-ring of a mechanical seal housing is prevented from being caught between an upper casing and a lower casing when the upper casing is placed on the lower casing.

A horizontal centrifugal separator of the present invention includes: a rotary bowl; a screw conveyor that is inserted into the rotary bowl; a casing that contains the rotary bowl and the screw conveyor; and bearing means for supporting a rotary shaft of the rotary bowl that extends through an opening of the casing. The horizontal centrifugal separator further includes sealing means for hermetically sealing the casing by providing a groove formed along a joint surface between an upper casing and a lower casing constituting the casing so as to be outwardly bent near the opening thereof, and disposing an elastic sealing member in the groove such that an end of the elastic sealing member abuts against a sealing surface provided on a ring member, the ring member being provided so as to surround an outer circumference of the opening and being pressed against the casing.

The elastic sealing member may include: a block member having an end that abuts against the sealing surface; and a linear member having an end that engages with a recess formed in the other end of the block member.

The ring member may be a flange portion of a bushing that is fitted, from an axially outward side of the opening, in a gap between the opening of the casing and a mechanical seal housing for sealing the rotary shaft disposed in the opening of the casing. The sealing surface may be configured to be a surface of a gasket sandwiched between the flange portion and a surface of the casing.

The present invention employs the structure in which surface sealing is formed as follows. Specifically, the groove formed along the joint surface between the upper casing and the lower casing constituting the casing is provided so as to be outwardly bent near the opening. Then, the elastic sealing member is disposed in the groove such that the end of the elastic sealing member abuts against the sealing surface provided on the ring member, the ring member being provided so as to surround the outer circumference of the opening and being pressed against the casing. In this manner, the hermeticity can be improved without using sealing means having a complicated structure.

In addition, the present invention employs the structure further including the bushing that is fitted, from the axially outward side of the opening, in the gap between the opening of the casing and the mechanical seal housing disposed in the opening of the casing. In this manner, the O-ring of the mechanical seal housing can be prevented from being caught between the upper casing and the lower casing when the upper casing is placed on the lower casing. Therefore, a reduction in hermeticity caused by the deformation of the O-ring can be prevented.

DETAILED DESCRIPTION OF THE INVENTION

Figure 1:
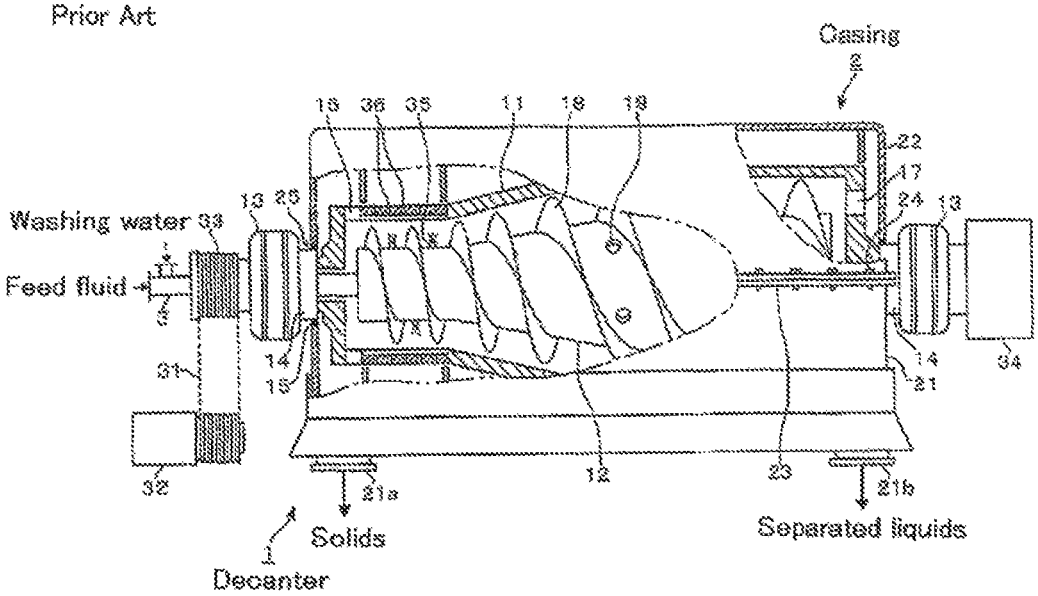
FIG.1 Prior Art
FIG. 1 is a vertical cross-sectional view illustrating the whole structure of a horizontal decanter.
Figure 2:
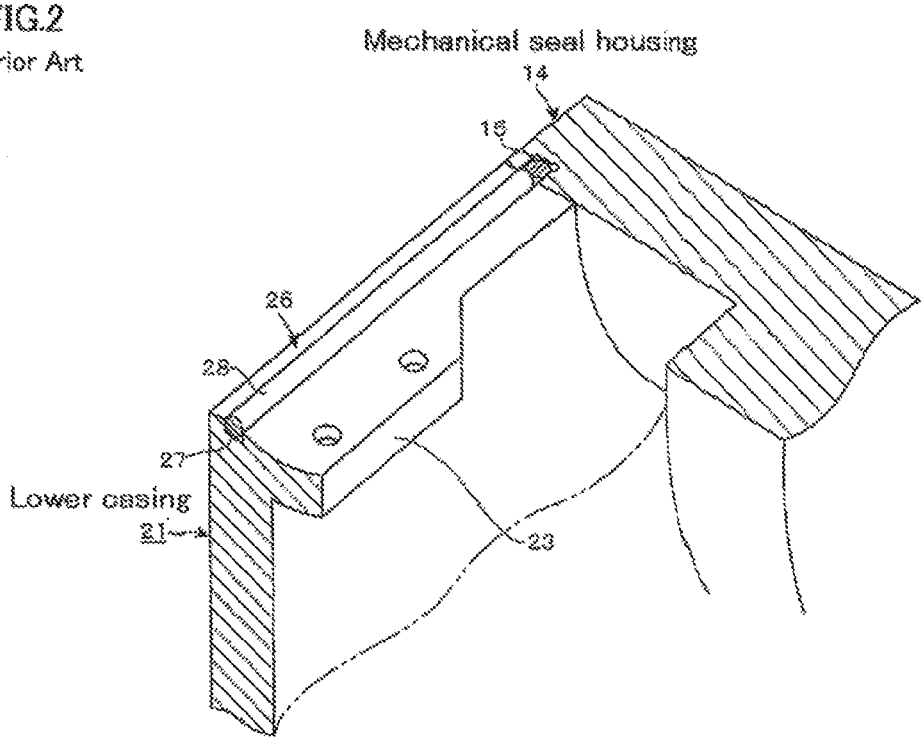
FIG.2 Prior Art
FIG. 2 shows a conventional sealing structure.

A horizontal centrifugal separator according to a preferred embodiment of the present invention will be described in detail with reference to the accompanying drawings. The basic structure of the horizontal centrifugal separator of the present embodiment is the same as the structure shown in FIG. 1, and a detailed description thereof will be omitted.

Figure 3:
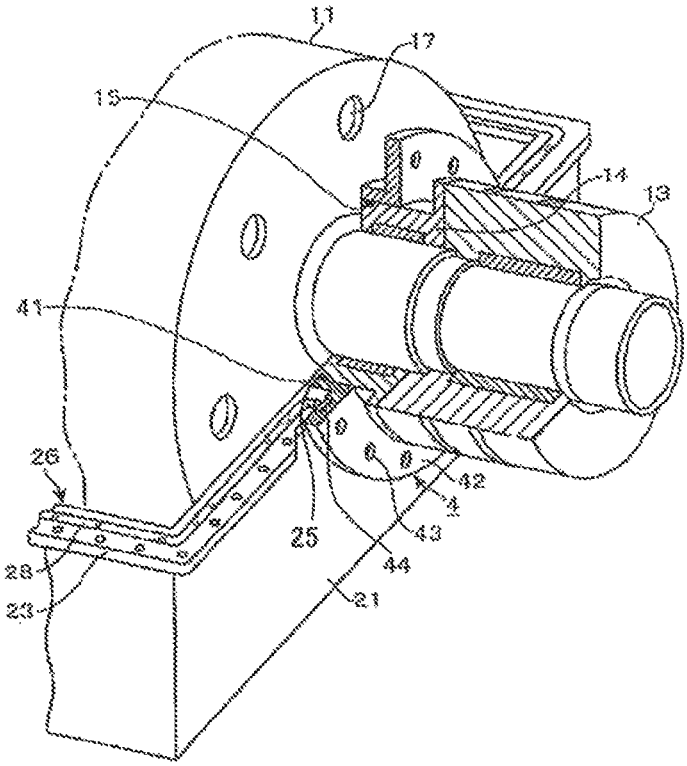
FIG. 3 shows a sealing structure according to an embodiment of the present invention.
Figure 4:
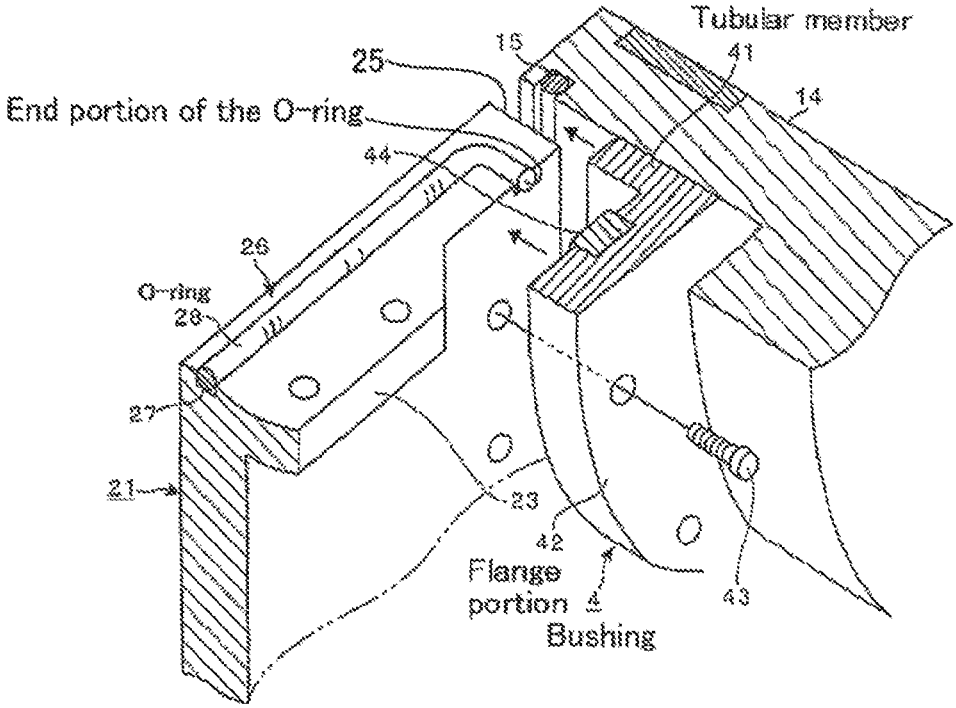
FIG. 4 shows the sealing structure according to the embodiment of the present invention.

As shown in FIGS. 3 and 4, in the horizontal centrifugal separator of the present embodiment, a groove 27 in which an O-ring (linear member) 28 serving as an elastic sealing member is disposed is bent outwardly near the opening 25 such that an end portion of the O-ring 28 is exposed outward. The end portion of the O-ring 28 may be flush with the surface of the casing or may protrude slightly from the surface of the casing.

The horizontal centrifugal separator further includes a bushing 4 fitted in the gap between the opening 25 and the mechanical seal housing 14. The bushing 4 includes: a tubular portion 41 that is fitted in the gap; and a flange portion 42 serving as a ring member formed in the outer circumference of the tubular portion 41, and is pressed against the casing 2 using securing means 43 such as a bolt. In this case, it is configured such that the end portion of the O-ring 28 abuts against a surface of a gasket 44 interposed between the flange portion 42 and the casing 2.

When the separator having the above structure is assembled, first the O-ring 28 is disposed in the groove 27. After the position of the mechanical seal housing 14 is adjusted, the upper casing 22 is placed. Then, the bushing 4 is caused to slide in the axial direction to fit the tubular portion 41 in the gap, and the flange portion 42 is pressed against the casing 2 using the securing means 43. In this manner, the end portion of the O-ring 28 abuts against the gasket 44, whereby sealing is formed.

Specifically, the sealing means of the present embodiment provides sealing which is constituted by the outwardly bent O-ring 28 and the gasket 44 provided in the bushing 4 in place of the conventional structure in which the sealing is constituted by the O-ring 28 on the casing side and the O-ring 15 of the mechanical seal housing 14. Therefore, according to the present embodiment, surface sealing using the surface of the gasket 44 is provided. Hence, the hermeticity can be further improved as compared to the conventional point contact sealing. Moreover, no significant modification is made to the conventional sealing structure, and therefore the hermeticity can be improved using a simple structure. In other words, the problem of hermeticity is overcome without sacrificing the advantages of low-cost horizontal decanters having a simple structure.

Moreover, the present embodiment employs the structure that further includes the bushing 4 fitted, from the axially outward side, in the gap between the opening 25 of the casing 2 and the mechanical seal housing 14. In this manner, the O-ring 15 of the mechanical seal housing 14 is prevented from being caught between the upper casing 22 and the lower casing 21 when the upper casing 22 is placed on the lower casing 21. Therefore, a reduction in hermeticity caused by the deformation of the O-ring 15 can be prevented.

Furthermore, in the present embodiment, the sealing area between the O-ring 28 and the gasket 44 is easily observed and inspected. Therefore, even when a change in pressure is found in a hermetic test, it is easily determined whether or not the leakage occurs in the sealing area. In other words, advantageously, the point of leakage is easily determined and fixed.

Figure 5:
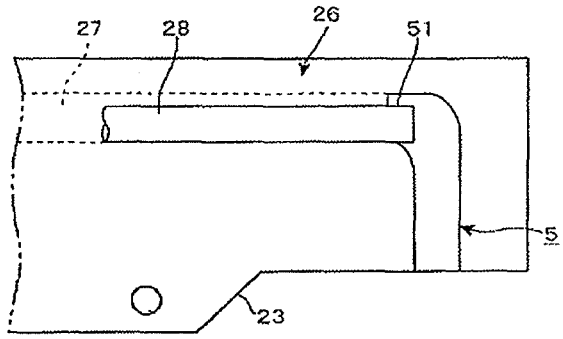
FIG. 5 shows a modified example of the sealing structure according to the embodiment of the present invention.
Figure 5:
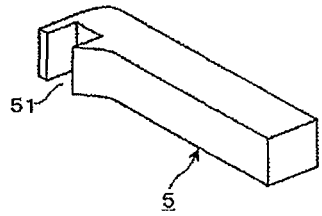
Figure 6:
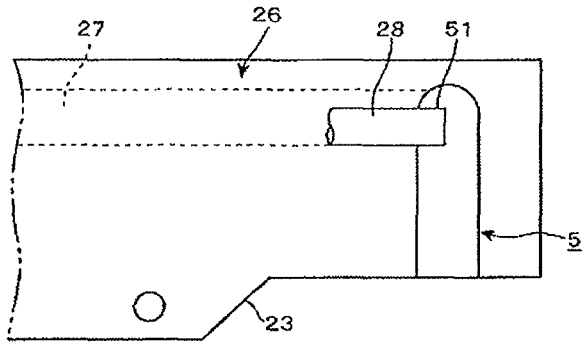
FIG. 6 shows another modified example of the sealing structure according to the embodiment of the present invention.
Figure 6:
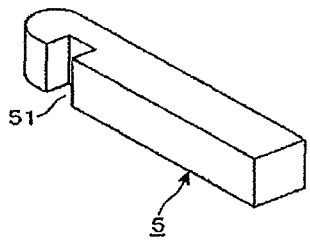

Moreover, in a modified example of the elastic sealing member, a block member 5 shown in, for example, FIG. 5 may be provided. Specifically, in this structure, the block member 5 is fitted in the groove 27 from the bent portion to the end portion thereof. As in the O-ring, one end portion of the block member 5 may be flush with the surface of the casing or may protrude slightly from the surface of the casing. The block member 5 has a recess 51 formed in the other end portion thereof, and the end portion of the O-ring 28 is engaged with the inside of the recess 51. The O-ring 28 may be bonded or not be bonded to the recess 51 to form the engagement between the O-ring 28 and the recess 51. Preferably, the O-ring 28 and the recess 51 are not bonded to each other when an appropriate bonding agent is not found for the engagement shape, or since the O-ring 28 and the recess 51 are difficult to reuse when bonded to each other. Even in such a structure, the same effects as those in the above embodiment can be obtained, and the hermeticity can be reliably improved by providing the block member 5 serving as an elastic sealing member. The shape of the block member 5 is not limited to the shape shown in FIG. 5, and the shape may be changed appropriately. For example, the shape shown in FIG. 6 may be used as a modified example.

In the above embodiment, the sealing member disposed in the groove 27 is not limited to the O-ring 28 having a circular cross-section. Any linear member may be used so long as it can be disposed in the groove 27. For example, a sealing member having a rectangular cross-section or other cross-section may be used.

The sealing surface against which the end of the elastic sealing member abuts is not limited to the surface of the gasket 44 of the bushing 4 and may be a surface of a sealing member other than the gasket 44. Alternatively, the sealing surface may be formed by applying RTV (Room Temperature Valcanizing) rubber. The ring member on which the sealing surface is provided is not limited to the flange portion 42 of the bushing 4 and may be other ring members.

It is needless to say that the application of the decanter is not limited. The decanter can be used for separation of various materials into solids and liquids and for selection of, for example, waste plastic.

While the present invention has been described with reference to the specific embodiments, it is apparent to those having ordinary knowledge in the art that various modifications can be made so long as they do not depart from the scope of the present invention. Accordingly, the technical scope of the present invention is not limited to the above-described embodiments but must be defined by the claims or the equivalence thereof.

Example

A hermeticity test was actually performed using the sealing means having the structure shown in FIG. 5. An example of the results is described below.

(Test Conditions)

O-ring Cross Section Dia.: 11 mm, Durometer: 50
Groove Depth: 8 mm
Rubber Ring Gasket Durometer: 60
Block Durometer: 70
Pressure (kg/cm$^2$): 0.35, 1.0, 1.25, 1.5
Retention time: 10 to 20 min (Test Results)

Leakage was not found at all the pressures listed above. In other word, sufficient hermeticity was confirmed in the present invention.

The invention claimed is:

1. A horizontal centrifugal separator comprising:
a rotary bowl including a rotary shaft;
a screw conveyor inserted into the rotary bowl;
a casing having an opening, and containing the rotary bowl and the screw conveyor;
a ring member having a sealing surface; and
a bearing device supporting the rotary shaft of the rotary bowl, the rotary shaft extending through the opening of the casing,
wherein the casing comprises an upper casing having a first semicircular notch and a lower casing having a second semicircular notch, and the first semicircular notch and the second semicircular notch form the opening,
wherein the horizontal centrifugal separator further comprises a sealing device hermetically sealing the casing, the sealing device including a groove along a joint surface between the upper casing and the lower casing, the groove being outwardly bent near an opening thereof, and an elastic sealing member disposed in the groove such that an end of the elastic sealing member abuts against the sealing surface on the ring member, the ring member being disposed so as to surround an outer circumference of the opening of the casing and being arranged so as to be pressed against the casing.

2. The horizontal centrifugal separator according to claim 1, wherein the elastic sealing member includes a block member having a first end that abuts against the sealing surface, and a linear member having an end that engages with a recess in a second end of the block member.

3. The horizontal centrifugal separator according to claim 2, wherein
the ring member is a flange portion of a bushing that is fitted, from an axially outward side of the opening, in a gap between the opening of the casing and a mechanical seal housing for sealing the rotary shaft disposed in the opening of the casing, and
the sealing surface is a surface of a gasket sandwiched between the flange portion and a surface of the casing.

4. The horizontal centrifugal separator according to claim 1, wherein
the ring member is a flange portion of a bushing that is fitted, from an axially outward side of the opening, in a gap between the opening of the casing and a mechanical seal housing for sealing the rotary shaft disposed in the opening of the casing, and the sealing surface is a surface of a gasket sandwiched between the flange portion and a surface of the casing.

* * * * *